US007290741B1

(12) United States Patent
Cox et al.

(10) Patent No.: US 7,290,741 B1
(45) Date of Patent: Nov. 6, 2007

(54) FURNITURE GLIDE

(75) Inventors: Dorsey Cox, Leeds, AL (US); Derek Popp, Elgin, IL (US)

(73) Assignee: Jacob Holtz Company, Philadelphia, PA (US)

( * ) Notice: Subject to any disclaimer, the term of this patent is extended or adjusted under 35 U.S.C. 154(b) by 103 days.

(21) Appl. No.: 10/977,829

(22) Filed: Nov. 1, 2004

(51) Int. Cl.
*F16M 11/24* (2006.01)

(52) U.S. Cl. ..... 248/188.4; 248/649

(58) Field of Classification Search ..... 248/476, 248/479, 188.4, 188.3, 649; 411/400, 401; 403/113, 350, 352
See application file for complete search history.

(56) References Cited

U.S. PATENT DOCUMENTS 259,665 A * 6/1882 Broomall et al. ..... 411/151
1,930,783 A * 10/1933 Watson et al. ..... 40/631
4,523,735 A * 6/1985 Beck et al. ..... 248/476
4,798,359 A * 1/1989 Ball ..... 248/188.3
5,081,546 A * 1/1992 Bottrill ..... 359/841
7,104,511 B2 * 9/2006 Smith et al. ..... 248/188.2

* cited by examiner

*Primary Examiner*—Korie H. Chan
(74) *Attorney, Agent, or Firm*—Rudoler & DeRosa LLC

(57) ABSTRACT

An improved self-adjusting furniture support includes a cam mechanism that limits the rotatability of the upper cover with respect to the central mounting bolt to provide for hand turning of the support both onto and off of a piece of furniture. A lower member or foot axially slides along the mounting bolt without rotating with respect thereto to provide adjustability of the height of the support without marring or rotatably scraping the floor or other surface on which it sets.

33 Claims, 3 Drawing Sheets

FURNITURE GLIDE

The present invention relates generally to self-adjusting furniture supports, and more particularly, to a new and improved spring loaded rotating ramp-type automatically adjusting furniture support that may be mounted on and removed from piece of furniture by hand threading same thereon without the use of manual or automatic tools.

BACKGROUND OF THE INVENTION

Furniture glides provide for adjustment of tables or other pieces of furniture having more than 3 legs. Such furniture supports may be adjustable either manually or automatically. In U.S. Pat. No. 4,798,359, one style of automatically adjustable furniture glide is shown and described. That style includes wedge ramped upper and lower members with a coil spring biased therebetween and retained together by an elongate bolt and a top mounting nut. The support provides height adjustment by allowing the upper ramp member to rotate with respect to the lower ramp member with the tops of the ramps sliding across one another. The lower member outwardly with respect to the upper member while allowing both members to rotate on the bolt or stud mounting that is threaded into the furniture or table leg. This furniture glide has been unique in the industry in allowing the upper ramp member to rotate with respect to the mounting bolt or stud. In all other manually self-adjusting furniture glides known to applicant, an upper member is solidly connected to the bolt or threaded stud so that when the stud is fully threaded into a furniture or table leg, the upper member of the furniture glide will also no longer turn. In such furniture glides it is the lower member that rotates to ramp up or down with respect to the upper member and make up any unevenness in the lengths of the respective furniture or table legs. Having the lower ramp member rotate while adjusting the height of the table glide may cause swirl or other marks to appear on the floor or other surface on which the table is positioned, especially if there is debris between the floor and bottom member. In the design shown in U.S. Pat. No. 4,798,359, the bottom member does not necessarily have to rotate since both members are free to rotate with respect to the bolt or stud. While this provides for superior adjustability, the independent rotatability of the upper and lower ramp members with respect to the bolt or stud means that such a furniture glide cannot be tightened or loosened manually to the extent that the design having the upper member fixed to the stud can be.

While the freely rotatable type of furniture glide may have its bolt or stud securely mounted to a piece of furniture or table leg by use of a screw driver, allen wrench, etc. in the field, such simple tools may not be readily available, even if they are originally packaged with the table supports. The fixed type of mechanically ramped self-adjusting furniture glide is more easily hand turnable or mountable on a furniture or table leg or the like by finger manipulation of the larger upper ramp member since it is solidly mounted to the threaded mounting.

A need has developed for an improved ramp-type mechanical self-adjusting furniture glide that continues to provide the advantages of rotatability between the upper ramp member and the threaded mounting bolt or stud while also providing ease of manual or finger controlled threading of the furniture glide both onto and off of a furniture leg, table leg or the like, without the necessity of using hand tools.

It is an object of the present invention, generally stated, to provide a new and improved self-adjusting furniture glide. It is a further object of the present invention to provide an improved self-adjusting mechanically acting furniture glide that may be easily mounted on and removed from a furniture or table leg by the use of hand or finger manipulation without the use of hand tools.

SUMMARY OF THE INVENTION

The invention is directed to a self-adjusting furniture support for use with a piece of furniture having a bottom base surface. The support includes a combination including shaft means for mounting on a base of a piece of furniture and extending in a vertical direction. An upper member is rotatably mounted on the shaft means and has a downwardly facing inclined ramp surface. Abutment means are positioned concentric with the shaft means for spacing the upper member from the furniture base surface while permitting relative rotation between the two. A lower foot member is also mounted on the shaft means and has an upwardly facing inclined ramp surface that slidingly engages the ramp surface on the upper member. Coil spring means bias the upper and lower members apart. The shaft means includes cam means extending radially therefrom. Combinations of two of the shaft means, upper member and lower member include cam means and complementary cam means thereon for limiting the relative rotatability of the upper member to the lower shaft means to less than about one half of one rotation. The invention is further directed to key means on the shaft means. The lower member includes keyway means thereon for slidably receiving the key means therein.

GENERAL DESCRIPTION OF THE DRAWINGS

The features of the present invention which are believed to be novel are set forth in the attached claims. The invention may best be understood by reference to the following description taken in conjunction with the accompanying drawings in which like numerals refer to like parts, and in which:

DETAILED DESCRIPTION OF THE PREFERRED EMBODIMENT OF THE INVENTION

Figure 1:
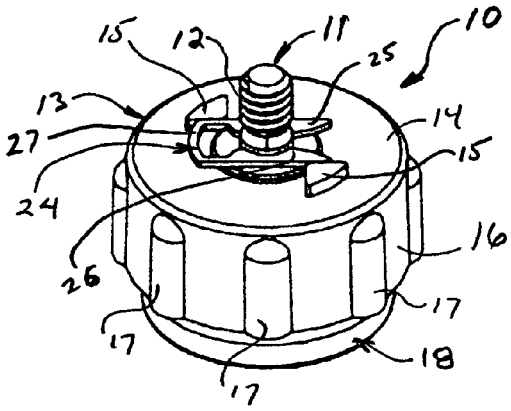
FIG. 1 is a top ¾ perspective view of a furniture glide constructed in accordance with the present invention shown in extended position.

Referring to FIG. 1, an automatically adjustable furniture glide, constructed in accordance with the present invention, generally indicated at 10, and includes a threaded mounting bolt 11 that will be shown in two variations in this application. Threaded bolt 11 includes threads 12 positioned on a distal end thereof that are a standard size (¼×20, 5/16×18, ⅜×16) and fitted to be threaded into an interiorly threaded retaining bracket (not shown) mounted on the distal end of a piece of furniture or table leg (not shown). Threaded bolt 11 extends axially substantially through the furniture glide 10, holds the entire glide together, and will be discussed in greater detail below.

Furniture glide 10 further includes a substantially hollow upper cover member, generally indicated at 13 preferably made of molded plastic or the like, that is hollow, includes a generally flat circular top 14 that has a pair of diametrically opposed pie shaped cams 15-15 raised thereon, and a generally cylindrical side wall 16 including a plurality of raised ribs 17-17 positioned in axial spaced orientation around the outside of cylindrical side wall 16.

A lower portion or foot, generally indicated at 18 has an outer diameter that is smaller than an inner diameter of the hollow upper cover and includes a flat annular base 20, a generally cylindrical hollow inner wall 21 for receiving the head of bolt 11 therein and a pair of diametrically opposed axially oriented rectangular keyways 22, 23, the purpose of which will be discussed below.

Referring to in FIGS. 1 and 3, a C-shape clip, generally indicated at 24 is retained on the bolt in a manner to be discussed below to limit the movement of the upper cover axially along the bolt 11. These members together with a coil spring (FIG. 5) mounted inside the upper cover or member and lower foot portion make up the improved furniture glide of the present invention. C-shape clip 24 includes a pair of elongate parallel legs 25, 26, joined together at one end in a bight portion 27. Each leg fits in a groove in the side of bolt 11 (to be discussed in more detail below). Each leg, in this first version, has straight parallel outer sides.

Figure 3:
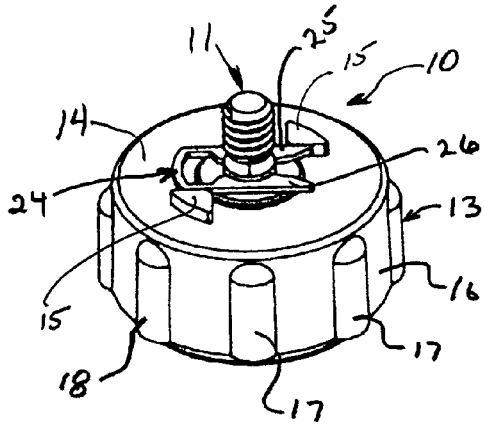
FIG. 3 is a top ¾ perspective view of the furniture glide of the invention shown in its most compressed position.
Figure 2:
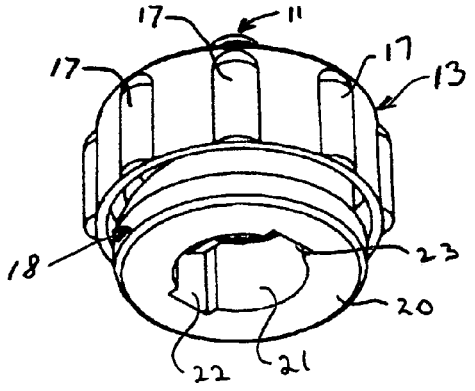
FIG. 2 is a bottom ¾ perspective view of the furniture glide of the invention shown in FIG. 1 in its extended position.
Figure 4:
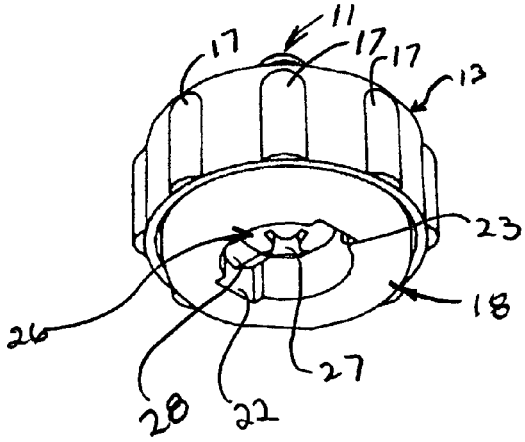
FIG. 4 is a bottom ¾ perspective view of the furniture glide of the invention its most compressed position.

As can be seen in FIGS. 3 and 4, when the furniture glide 10 of the invention is in its most compressed state, the hollow top cover 13 has rotated, in this embodiment, about 90 degrees so that the pie-shape cams 15 that extend upwardly from the flat annular top 14 of cover 13 shift clockwise until they impinge on the flat outer sides of the legs 25, 26 of the C-shape metal clip 24. With that clockwise turn of top 14, the inner workings of the furniture glide, to be discussed in more detail below, provide for the axial upward movement of the lower or foot member 18 with respect to the bolt 11 approximating 3/16 inch. It should be noted that the foot portion 18 does not rotate during the height adjustment. As shown most clearly in the difference between FIGS. 2 and 4, the axial movement of the lower or foot portion 18 up the bolt 11, allows the head 26 of the bolt 11 to show in this first version that it include a phillips head slot 27 and one of a pair of opposingly extending keys 28-28 (one shown), that slide axially in keyways 22, 23, respectively. The lower or foot portion 18 does not rotate while the furniture glide is self-adjusting, but slides axially along bolt 11, thus avoiding scratching any floor or base surface upon which the furniture glide is positioned.

Referring to FIGS. 5-8, a modified version of the furniture glide 10 of the invention includes a snap ring 30 having curved outer surfaces on its legs 31, 32, but includes the same notched inner edges 33, 34 and bight or joinder portion 35 as found in the first version snap ring 24. In this modified version of the furniture glide 10 of the present invention, the only other change from the first version is an allen head slot 36 in the head 37 of the bolt, generally indicated at 38.

Figure 7:
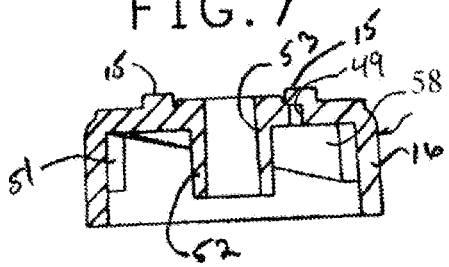
FIG. 7 is a cross-sectional view taken along line 7-7 of FIG. 5.
Figure 8:
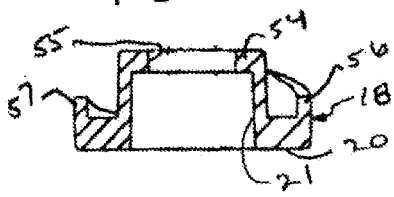
FIG. 8 is a cross-sectional view of the bottom member taken along line 8-8 of FIG. 6.

As shown most clearly in FIGS. 7 and 8, the bolt 38 of the first modification, similarly to bolt 11, includes a threaded upper end 40 and a cylindrical body portion 41 positioned between the threaded distal end 40 and the head 37. The termination of threads 12 at the cylindrical body position 41 provides a stop to limit the insertion of the support into a table leg mounting (not shown) and allows cover 13 to rotate with respect to an adjacent table leg bottom surface. Adjacent the top of cylindrical portion 41 are an opposed pair of slots 42-42 (only one shown) that is sized to retain the notches 33, 34 respectively, of the spring clip 30 therein to maintain the entire assembly in completed biased assembled condition.

Figure 5:
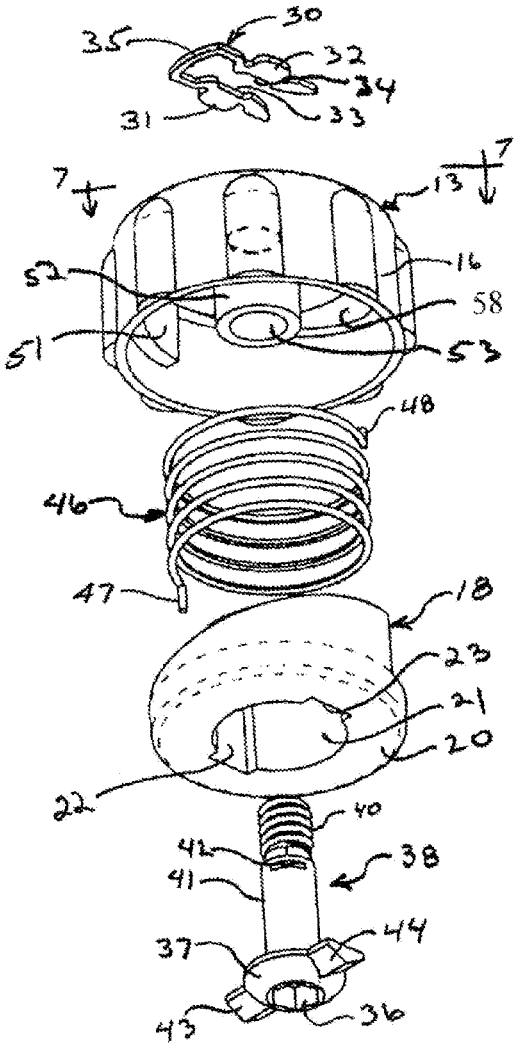
FIG. 5 is a bottom ¾ exploded perspective view of a modified embodiment of the present invention.
Figure 6:
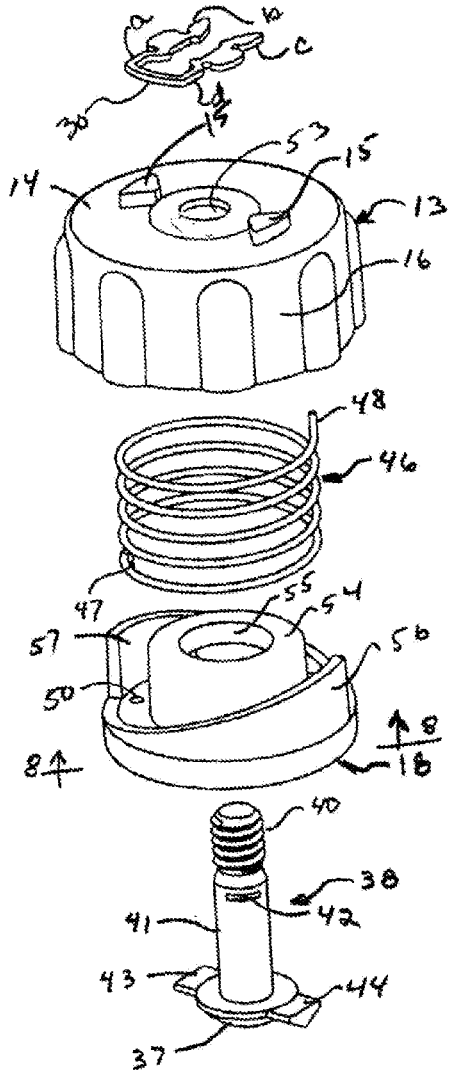
FIG. 6 is a top ¾ exploded perspective view of a modified embodiment of the present invention.

The modified bolt 38 shown in FIGS. 5 and 6, most clearly shows the shape and location of the keys 43, 44 that extend from opposing sides of the head 37 of bolt 38 ride in keyways 22, 23 of the bottom or foot member 18, providing for axial movement of the member 18 along the bolt 38 while eliminating rotational movement between those two members. The body portion of bolt 38 could also be rectangular, square or hexagonal within the scope of the invention, with a complementary shaped lower member hub to provide sliding non-rotational fit therebetween. An enlarged square or hexagonal head can also perform an identical function with a complementary shaped recess in the lower member.

The last member of the furniture glide 10 to be discussed is a coil spring, generally indicated at 46, which includes a plurality of coils sized to fit an annular hollow space in bottom or foot member 18 and includes a pair of bent opposed distal ends 47, 48 that fit in cylindrical mounting recesses 49 in the upper cover member (FIG. 7) and 50 (FIG. 6) in the lower or foot member.

Spring 46 biases the upper member or cover 13 and the lower member 18 axially outwardly to maximize the height of the furniture glide or the extension of the lower foot member 18 outwardly of the bottom of the upper cover 13 so that the upper cover 13 is biased against the spring clip 35 and the lower member 18 is biased against the head 37 and keys 43, 44 of the bolt 38. The spring 46 also biases the rotatability of the upper cover 13 relative the lower foot member 18. This torque bias may be more pronounced to a user in the instant furniture glide than in prior art furniture glides because in prior art furniture glides, the bottom or foot portion is free to rotate on the bolt 40 as is the top or cover portion 13.

Referring to FIGS. 5-8, an upper member 13 and lower or foot member 18 are shown both in perspective in FIGS. 5 and 6 and in cross-section in FIGS. 7 and 8, respectively. Both members are preferably made of plastic and the side wall 16 approximates 1/16 inch in thickness as does the pair of ramps 51-58 that each spiral around 50 percent of the circumference of the inner surface of sidewall 16, as shown most clearly in FIG. 5. At the center of cover member 13 is a hub 52 that extends axially along a greater portion of the height of cover member 13 and provides a hollow cylindrical opening 53 that is sized to slidably receive the solid cylindrical portion 41 of the bolt 38 therein to provide axial and rotational movement of the cover therebetween. In this embodiment, the cams, stops or limiters 15-15 on the top of the cover top surface 14 are pie-shaped to provide flat surface-to-surface contact between the straight outer wall portions of the legs of the spring clip 30 and as thus formed provide for a 90 degree maximum rotatability in this embodiment of the cover 13 with respect to the foot portion 18. Differing shaped cams can be made to provide for differing duration or rotatability of the cover member 13 with respect to the bolt and the base or foot member 18 to a maximum of 180 degrees. The lower or foot portion 18 as previously indicated includes a bottom annular surface 20. In this embodiment, the outer diameter of base or foot member 18 approximates 1⅛ inches. As previously indicated, a hollow cylindrical opening 21 extends upwardly from the base surface 20 to a top annular wall 54 having a central aperture 55 positioned axially therethrough in which the hub 52 of the top member extends.

Rising upwardly from the outer circumference of the bottom annular surface 20 are a pair of 180 degree oriented ramps 56, 57 that are complementary to the ramps 51, 58 of the top member 13 such that their respective top surfaces will slightly engage as the top member is rotated with respect to the bottom member. The 180 degree duration of ramps 51, 58 and complementary ramps 56, 57 assure that the maximum rotatability of the top cover 13 with respect to the bottom or foot portion 18 is 180 degrees. The thickness of ramps 56, 57 also approximate 1/16 inch, similar to the thickness of ramps 51, 58.

Figure 9:
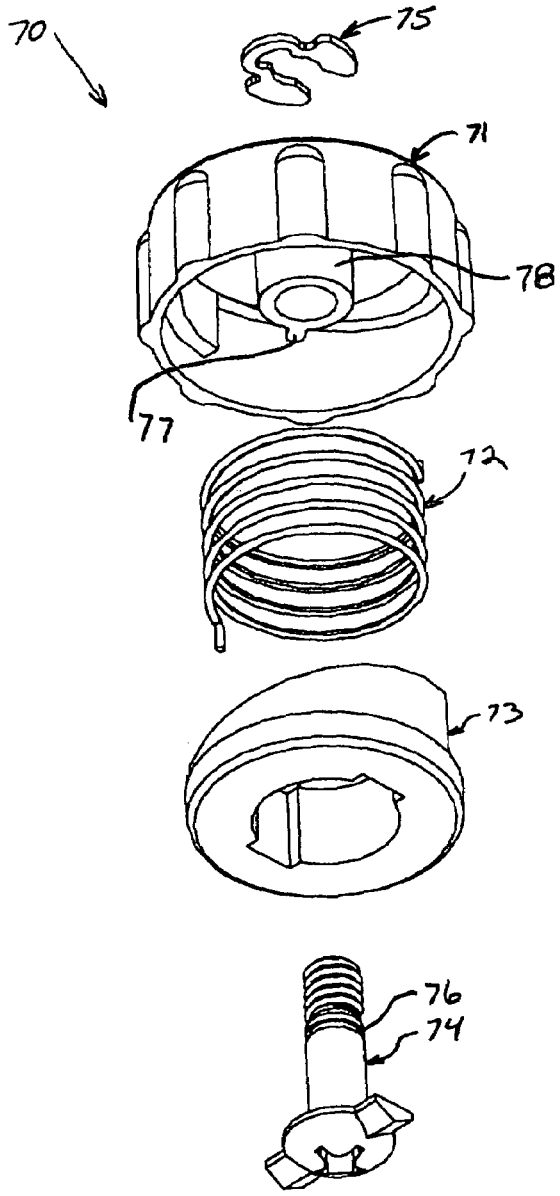
FIG. 9 is a bottom ¾ perspective view of a second modification of the present invention.
Figure 10:
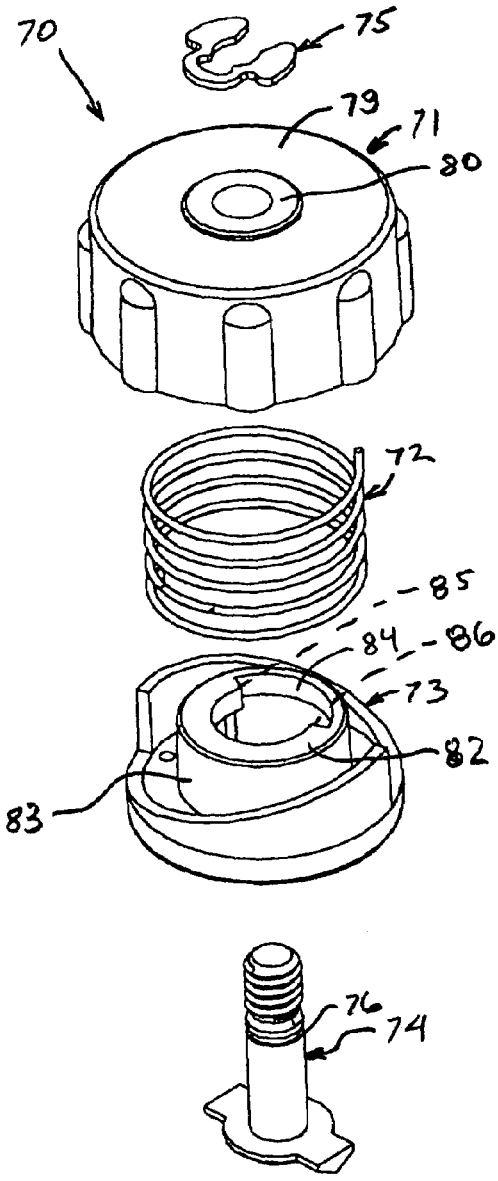
FIG. 10 is a top ¾ perspective view of the second modification shown in FIG. 9.

Referring to FIGS. 9 and 10, a second modification of the furniture glide of the present invention, generally indicated at 70, is substantially identical to the furniture glide shown at 10 with the exception that the cam mechanism limiting relative rotation between the cover and the lower or foot portion is found completely on the interior of those respective parts, and will be discussed in more detail below.

Like the first embodiment 10, this modification 70 includes a hollow upper cover, generally indicated at 71, a coil spring 72 identical to that shown at 46, a lower or foot portion, generally indicated at 73, and a bolt 74. The entire mechanism is held together by a standard C-shape spring clip 75. The standard C-shape spring clip 75 is retained in an annular groove 76 that extends radially around the outside of bolt 74 at the same location as slots 42-42 shown in bolt 38. The other modifications from the first embodiment 10 are found at a vertical rib or cam 77 positioned to radially extend from the outer surface of the top member hub 78. The location of cam 77 on hub 78 eliminates the need for the cams 15-15 shown in FIG. 6. Indeed, as shown most clearly in FIG. 10, in this modification, the hollow upper member 71 now has a flat annular top surface 79 outwardly of the top annular surface 80 of hub 78.

As shown most clearly in FIG. 10, the top annular wall 82 of the lower member hub 83, similar to top annular wall 54 of FIG. 6, includes a radially extending arcuate cutout 84 that extends approximately 134 degrees to provide space for the vertical rib 77 to rotate relative to the lower member or foot portion 73. The rotation of vertical rib 77 is limited by the vertical faces 85-86 that define the ends of radially extending annular slot 84. This second modification also allows the hollow upper cover 71 to freely rotate on bolt 74 through the 134 degree angular relative motion in which the vertical rib 77 may rotate in the radially extending arcuate cutout 84. Otherwise, the second modification 70 of the invention is sized and shaped identically to the first modification shown at 10 in FIGS. 1-4.

With the invention of the present embodiment assembled as shown in FIGS. 1-10, an improved self-adjusting furniture glide is shown and described that may be installed or mounted on a piece of furniture or furniture leg by hand turning the glide with the ribs 17-17 of upper cover 13 providing for ease of finger dexterity in hand tightening the glide against the furniture piece or furniture leg. Likewise, the furniture glide of the invention may be hand removable from the furniture piece or leg by finger manipulation of the outer surface 16 and ribs 17 of the upper cover 13. When removing the furniture glide 10 from a piece of furniture, the upper cover 13 will rotate approximately 90 degrees before the spring clip engage outer surfaces 30*a, b, c* and *d*, the cams 15-15 on the top surface 14 of the top cover 13 to limit rotation of the top cover and apply a counterclockwise torque to the threads on the bolt 11 to unscrew the bolt from the furniture leg or furniture piece. When the counterclockwise torque or motion is removed from the top cover, it springs back into an extended position.

While one embodiment of the present invention and two modifications thereof have been shown and described, it will be apparent to those skilled in the art that many changes and modifications may be made without departing from the true spirit and scope of the present invention. It is the intent of the appended claims to cover all such changes and modifications which fall within the true spirit and scope of the invention.

What is claimed is:

1. In a self-adjusting furniture support for use with a piece of furniture having a bottom base surface, said support including in combination:

shaft means for mounting on a base surface of said piece of furniture extending in a vertical direction, an upper member rotatably mounted on said shaft means and having a downwardly facing inclined ramp surface, a lower foot member mounted on said shaft means and having an upwardly facing inclined ramp surface slidably engaging said ramp surface on said upper member, and coil spring means mounted in coaxial relationship with said shaft means in a compressed state between said upper and lower members for exerting a force in a direction to push said members apart, an improvement comprising, said shaft means including cam means extending radially therefrom and, said upper member including complimentary cam means thereon for engaging said cam means extending radially from said shaft means to limit the rotational movement of said upper member relative said shaft to less than about half of one rotation.

2. The self-adjusting furniture support as defined in claim 1 further including, knurl means on an outer side of said upper member for aiding in finger rotation of said support clockwise and counter-clockwise by a user.

3. The self-adjusting furniture support as defined in claim 2 wherein said knurl means includes, a plurality of vertically extending ribs positioned in spaced relation on said outer side of said upper member.

4. The self-adjusting furniture glide as defined in claim 1 wherein said cam means of said shaft means includes a spring clip retained on said shaft means in non-rotatable fashion therewith.

5. The self-adjusting furniture glide as defined in claim 1 wherein said complementary cam means include detents extending upwardly from a top surface of said upper member positioned to limit the rotation of said upper member relative said cam means extending from said shaft means.

6. The self adjusting furniture support as defined in claim 1 wherein said shaft means includes a bolt having an enlarged bolt head defining one end thereof, a generally plain cylindrical body extending axially from said enlarged bolt head, a threaded distal portion extending from said cylindrical body and defining an opposing end of said bolt, and a slot means extending radially inwardly from said generally plain cylindrical body perpendicularly to an axis of said bolt for retaining a spring clip on said bolt.

7. The self adjusting furniture support as defined in claim 6 wherein said slot means includes a pair of opposing slots.

8. The self-adjusting furniture support as defined in claim 1 wherein, said cam means includes a spring clip mountable on said shaft means in non-rotatable relation relative thereto, said spring clip extending generally perpendicular to an axis of said shaft means, and including a plurality of generally flat outer surfaces for engaging said complimentary cam means on said upper member.

9. In a self-adjusting furniture support for use with a piece of furniture having a bottom base surface, said support including in combination:

shaft means extending in a vertical direction for mounting on a base surface of said piece of furniture, an upper member rotatably mounted on said shaft means and having a downwardly facing inclined ramp surface, a lower foot member mounted on said shaft means and having an upwardly facing inclined ramp surface slidably engaging said ramp surface on said upper member, and coil spring means mounted in coaxial relationship with said shaft means in a compressed state between said upper and lower members for exerting a force in a direction to push said members apart, an improvement comprising, said shaft means including cam means extending radially therefrom, said upper member including complimentary cam means thereon for engaging said cam means extending radially from said shaft means to limit the rotational movement of said upper member relative said shaft to less than about half of one rotation, said shaft means including key means thereon for eliminating rotational motion between said shaft means and said lower foot member, and said lower foot member including complementary key means thereon for axially slidably receiving said key means of said shaft means thereon.

10. In a self-adjusting furniture support for use with a piece of furniture having a bottom base surface, said support including in combination:

shaft means mounting on a base surface of said piece of furniture with said shaft extending in a vertical direction, an upper member rotatably mounted on said shaft, said upper member includes a first hollow hub through which said shaft means is received, a lower foot member axially slidably mounted on said shaft, coil spring means mounted in coaxial relationship with said shaft means in a compressed state between said upper and lower members for exerting a force in a direction to push said members apart, an improvement comprising, one of said upper member, said lower foot member, and said shaft means including cam means thereon for allowing rotational motion between said upper member and said lower foot member, one of the other of said upper member, said lower foot member and said shaft means including complementary cam means thereon for limiting relative rotational motion between said upper member and said lower foot member, said cam means includes a vertical rib extending radially outwardly from an outer surface of said hub, said lower foot member includes a second hollow hub thereon through which said shaft means is received and slidably retained, and said second hollow hub including said complementary cam means thereon for limiting the rotation of said vertical rib.

11. In a self-adjusting furniture support for use with a piece of furniture having a bottom base surface, said support including in combination:

shaft means mounting on a base surface of said piece of furniture with said shaft extending in a vertical direction, an upper member rotatably mounted on said shaft, a lower foot member axially slidably mounted on said shaft, coil spring means mounted in coaxial relationship with said shaft means in a compressed state between said upper and lower members for exerting a force in a direction to push said members apart, an improvement comprising, one of said upper member, said lower foot member, and said shaft means including cam means thereon for allowing rotational motion between said upper member and said lower foot member, one of the other of said upper member, said lower foot member and said shaft means including complementary cam means thereon for limiting relative rotational motion between said upper member and said lower foot member, and said upper member includes said cam means thereon, said lower foot member includes said complementary cam means thereon for limiting relative rotation between said upper member and said lower foot member.

12. The self-adjusting furniture support as defined in claim 11 wherein, said upper member includes a first hub, said cam means including a radially extending vertical rib on said hub having a thickness that can be defined arcuately, and said lower foot member includes a second hub, and said complementary cam means including an arcuately extending slot on said second hub on said lower foot member.

13. A self-adjusting furniture support for use with furniture having a bottom base surface, the support comprising:

a shaft extending in a vertical direction for mounting to the base surface of the furniture;

an upper member rotatably mounted on the shaft and having a downwardly facing inclined ramp surface;

a lower foot member mounted to the shaft and having an upwardly facing inclined ramp surface slidably engaging the ramp surface of the upper member, the lower foot member being rotatable relative to the upper member;

a spring mounted in a compressed state between the upper and lower members for exerting a force in a direction to push the upper and lower members apart; and one of the upper member and the lower foot member comprising a limiter and the other of upper member and the lower foot member comprising a complementary stop for limiting relative rotational motion therebetween.

14. The self-adjusting furniture support according to claim 13, wherein the shaft is non-rotatably mounted to the lower foot member.

15. The self-adjusting furniture support according to claim 13, wherein spring is a coil spring having one end positioned with respect to the upper member and an other end positioned with respect to the lower foot member for creating a torque bias between the upper and lower members during rotation therebetween.

16. The self-adjusting furniture support according to claim 13, wherein the limiter is formed on a hub formed on one of the upper and lower members, the shaft being mounted in the hub.

17. The self-adjusting furniture support according to claim 16 wherein the limiter comprises at least one radially extending rib.

18. The self-adjusting furniture support according to claim 13, wherein the complementary stop comprises at least one axially extending stop surface which cooperates with the limiter to limit relative rotation between the upper and lower members.

19. The self-adjusting furniture support according to claim 18, wherein the at least one axially extending stop surface is formed at the end of an arcuate slot.

20. The self-adjusting furniture support according to claim 13, wherein the limiter comprises at least one radially extending rib formed on a hub formed on one of the upper and lower members, the shaft being mounted in the hub, wherein the complementary stop comprises at least one axially extending stop surface which cooperates with the at least one rib to limit relative rotation between the upper and lower members.

21. The self-adjusting furniture support according to claim 20, wherein the at least one axially extending stop surface is formed at the end of an arcuate slot.

22. The self-adjusting furniture support according to claim 20, wherein the shaft is non-rotatably mounted to the lower foot member.

23. The self-adjusting furniture support according to claim 20, wherein spring is a coil spring having one end positioned with respect to the upper member and an other end positioned with respect to the lower foot member for creating a torque bias between the upper and lower members during rotation therebetween.

24. A self-adjusting furniture support for use with furniture having a bottom base surface, the support comprising:

a shaft extending in a vertical direction for mounting to the base surface of the furniture;

an upper member rotatably mounted on the shaft and having a downwardly facing inclined ramp surface;

a lower foot member mounted to the shaft and having an upwardly facing inclined ramp surface slidably engaging the ramp surface of the upper member, the lower foot member being rotatable relative to the upper member;

a spring mounted in a compressed state between the upper and lower members for exerting a force in a direction to push the upper and lower members apart; and one of the upper member and the lower foot member comprising at least one radially extending rib and the other of upper member and the lower foot member comprising a at least one axially extending stop surface which cooperates with the at least one rib to limit relative rotation between the upper and lower members.

25. The self-adjusting furniture support according to claim 24, wherein the at least one radially extending rib is formed on a hub formed on one of the upper and lower members and wherein the shaft is mounted in the hub.

26. The self-adjusting furniture support according to claim 24, wherein the shaft is non-rotatably mounted to the lower foot member.

27. The self-adjusting furniture support according to claim 24, wherein spring is a coil spring having one end positioned with respect to the upper member and an other end positioned with respect to the lower foot member for creating a torque bias between the upper and lower members during rotation therebetween.

28. The self-adjusting furniture support according to claim 13, wherein the upper member has an axially extending outer wall which forms a outer cover around the lower foot member.

29. The self-adjusting furniture support according to claim 20, wherein the upper member has an axially extending outer wall which forms a outer cover around the lower foot member.

30. The self-adjusting furniture support according to claim 24, wherein the upper member has an axially extending outer wall which forms a outer cover around the lower foot member.

31. The self-adjusting furniture support according to claim 13, wherein the shaft has a shape and the lower foot member has a mount having a complementary shape for receiving the shaft and preventing relative rotation therebetween.

32. The self-adjusting furniture support according to claim 20, wherein the shaft has a shape and the lower foot member has a mount having a complementary shape for receiving the shaft and preventing relative rotation therebetween.

33. The self-adjusting furniture support according to claim 24, wherein the shaft has a shape and the lower foot member has a mount having a complementary shape for receiving the shaft and preventing relative rotation therebetween.

* * * * *